US007191873B2

(12) United States Patent
Korchagin et al.

(10) Patent No.: US 7,191,873 B2
(45) Date of Patent: Mar. 20, 2007

(54) HIGH-RISE FIRE-FIGHTING, RESCUE AND CONSTRUCTION EQUIPMENT

(75) Inventors: Pavel V. Korchagin, Apt. 99, House 39 Dubninskaya Street, Moscow, 127474 (RU); Marina E. Korchagina, Apt. 112, House 5 Second Khoroshevskiy Lane, Moscow 123007 (RU); Igor I. Goldstein, 13284 39th Ave. North, Plymouth, MN (US) 55446; Ilya G. Gordeev, Moscow (RU); Ekaterina A. Vinogradova, Ryazan (RU)

(73) Assignees: Pavel V. Korchagin, Moscow (RU); Marina E. Korchagina, Moscow (RU); Igor I. Goldstein, Plymouth, MN (US); Andre G. Tirskiy, Moscow (RU)

( * ) Notice: Subject to any disclaimer, the term of this patent is extended or adjusted under 35 U.S.C. 154(b) by 264 days.

(21) Appl. No.: 10/680,369

(22) Filed: Oct. 7, 2003

(65) Prior Publication Data

US 2005/0087393 A1 Apr. 28, 2005

(51) Int. Cl.

| | |
|---|---|
| ***B66B 9/00*** | (2006.01) |
| ***E04G 3/00*** | (2006.01) |
| ***E04G 1/18*** | (2006.01) |
| ***E04G 1/22*** | (2006.01) |
| ***E04G 3/28*** | (2006.01) |

(52) U.S. Cl. ..... 187/239; 182/82; 182/141; 182/142; 182/147

(58) Field of Classification Search ..... 182/82, 182/101, 142–149; 187/239
See application file for complete search history.

(56) References Cited

U.S. PATENT DOCUMENTS

| | | | | | |
|---|---|---|---|---|---|
| 115,093 | A * | 5/1871 | Nemeth | 70/429 |
| 642,779 | A * | 2/1900 | Bates | 182/141 |
| 3,878,916 | A * | 4/1975 | White, Jr. | 182/145 |
| 4,098,371 | A * | 7/1978 | Cox | 182/2.7 |
| 4,121,693 | A * | 10/1978 | Fry | 182/131 |
| 4,469,198 | A * | 9/1984 | Crump | 182/141 |
| 4,640,384 | A * | 2/1987 | Kucher et al. | 182/51 |
| 4,828,072 | A * | 5/1989 | Ho | 182/9 |
| 4,887,694 | A * | 12/1989 | Ho | 182/82 |
| 4,984,321 | A * | 1/1991 | Larson | 14/71.5 |
| 5,113,969 | A * | 5/1992 | Drolet et al. | 182/2.11 |
| 5,127,491 | A * | 7/1992 | Just-Buddy | 182/142 |
| 5,582,467 | A * | 12/1996 | Drolet et al. | 299/33 |
| 6,443,262 | B1 * | 9/2002 | Karanouh | 182/178.1 |

(Continued)

FOREIGN PATENT DOCUMENTS

WO WO 2005025288 A2 * 3/2005

*Primary Examiner*—Patrick Mackey
*Assistant Examiner*—Eric E. Pico
(74) *Attorney, Agent, or Firm*—Steven E. Kahm; Nikolai & Mersereau, P.A.

(57) ABSTRACT

For fire fighting and emergency rescue in high-rise buildings the building can be equipped with rails on the outside of the building. The rails have elevators, which travel on the rails on the outside face of the building. Two elevators traveling in unison and supporting a platform extending therebetween can provide a corridor and or a scaffold for reaching anyplace on the face of a building. Other elevators or elevators with cranes can be used on the rails in combination with the elevators with the platform to fight fires, rescue people from the upper floors of buildings or perform maintenance or construction tasks.

18 Claims, 7 Drawing Sheets

U.S. PATENT DOCUMENTS 6,598,706 B1 * 7/2003 Takeuchi ..... 187/239
2004/0262086 A1 * 12/2004 Korchagin et al. ..... 187/239
2005/0016794 A1 * 1/2005 Korchagin et al. ..... 182/82
2005/0023082 A1 * 2/2005 Korchagin et al. ..... 182/82

* cited by examiner

HIGH-RISE FIRE-FIGHTING, RESCUE AND CONSTRUCTION EQUIPMENT

BACKGROUND OF THE INVENTION

1. Field of the Invention

This invention relates to elevators on rails on the outside of a building and more particularly to two elevators on such rails with a corridor attached between them to act as a moveable platform for fire fighting, emergency rescue, building construction and building maintenance.

2. Description of the Related Art

Some buildings have elevators on the outside of the building, which offers a nice view as the elevator ascends and descends the side of the building. These are standard elevators and are not to be used during fires. The elevators have cables and are enclosed within the structure of the building to protect the elevator parts. There is usually a glass enclosure for the elevator so that people in the elevator can look out through the side of the building. These elevators are not available for removing large numbers of people from a building during a fire and are not useful for fighting fires or performing maintenance or construction work on the building.

There are window-washing platforms that use ropes on either side of the platform to support the platform as it travels up and down the side of the building. The ropes are spooled on a barrel, which is turned by an electric motor, which can be operated by someone on the platform.

There are no devices for spanning the entire face of a building, which can be raised and lowered to reach any point on the face of the building and can be used to fire fighting, emergency rescue, building maintenance or window washing.

SUMMARY OF THE INVENTION

A pair of elevators riding on rails on the face of a building have a platform extending between them for accessing any point on the face of a building as the elevators are raised and lowered in unison. The platform can support a corridor such that people can enter the corridor and either walk therethrough to an adjacent corridor or be transported up or down in the corridor or a connecting outside elevator for emergency rescue operations. Pairs of elevators on each face of the building can be raised and lowered in cooperation with each other or individually to effect rescues. Other elevators or elevators with cranes thereon can also be used in conjunction with the pairs of elevators with a platform and corridor thereon for rescue, fire-fighting or building construction or maintenance.

OBJECTS OF THE INVENTION

It is an object of the invention to provide access to the entire outside face of a building.

It is an object of the invention to transport large numbers of people to safety in a corridor traveling on the face of a building.

It is an object of the invention to coordinate the movement of the platforms on the faces of a building with each other and other elevators for rescues and other functions.

It is an object of the invention to provide a platform across the face of a building for fire fighting.

It is an object of the invention to provide a platform across the face of a building for use in building construction and building maintenance.

Other objects, advantages and novel features of the present invention will become apparent from the following description of the preferred embodiments when considered in conjunction with the accompanying drawings.

DESCRIPTION OF THE PREFERRED EMBODIMENTS

In high-rise buildings it is difficult to gain access to the face of the building from the outside on the upper floors. It is particularly necessary to access the face of the buildings during fires such that fire fighters can extinguish the fire and to rescue people on the upper floors.

In a prior filed application, Ser. No. 10/205,981 entitled High-Rise Fire Fighting Rescue and Construction Equipment filed Jul. 26, 2002, which is attached hereto and incorporated herein by reference, the applicants have shown how to attach an mobile elevator from an emergence vehicle to a building for riding up and down rails secured to the outside of a building. The elevator has a crane thereon for extending a cab to any point on the face of the building for fire fighting and for rescuing people in the building.

The applicants have also filed application Ser. No. 10/334,023 entitled High-Rise Fire Fighting Rescue and Construction Equipment filed Dec. 30, 2002, which is attached hereto and incorporated herein by reference, which is similar to Ser. No. 10/205,981, however the newer application shows the use of cables to lift and lower the elevator on the rails attached to the outside of the building. The cables allow for the elevator cab to be lighter since the electric motors for propelling the elevator can be moved to the building to operate the cables rather than being in the elevator.

The applicants have also filed application Ser. No. 10/431946 entitled High-Rise Fire Fighting Rescue and Construction Equipment filed May 5, 2003, which is attached hereto and incorporated herein by reference, which adds a second elevator running on the rail to be used in conjunction with the elevator and crane to increase the transportation capacity during an emergency such that more people can be rescued in a shortened time frame.

The applicants herein add another feature to the elevator system for the outside of a building which can be used in conjunction with the previously disclosed inventions to again increase the number of people who can be rescued and provide for better access to the face of the building for use during emergencies of for building construction or maintenance.

Figure 1:
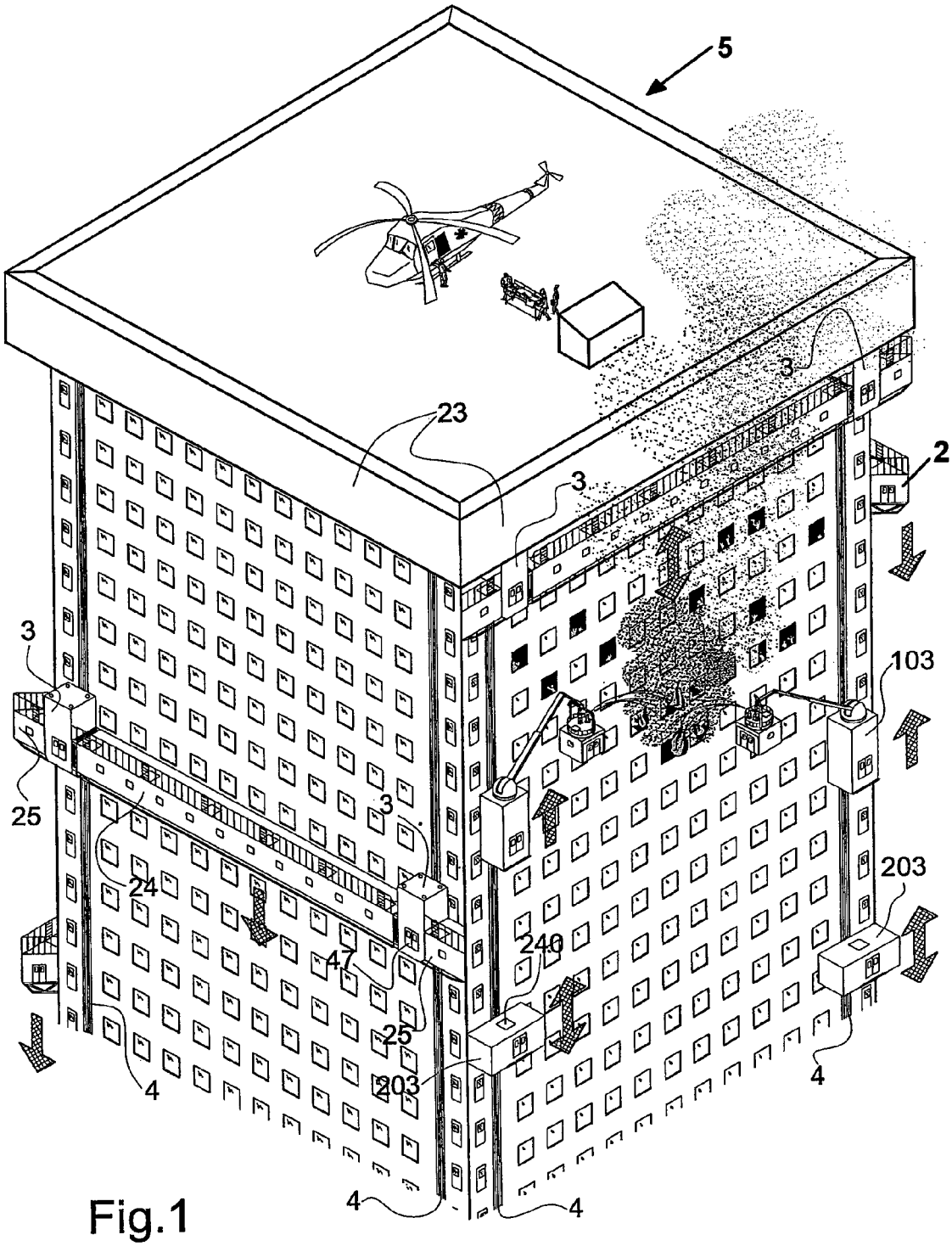
FIG. 1 shows two faces of a building equipped with a corridor extending between two elevator on the outside of a building, plus an elevator cab, and an elevator with crane, used during a fire.
Figure 2:
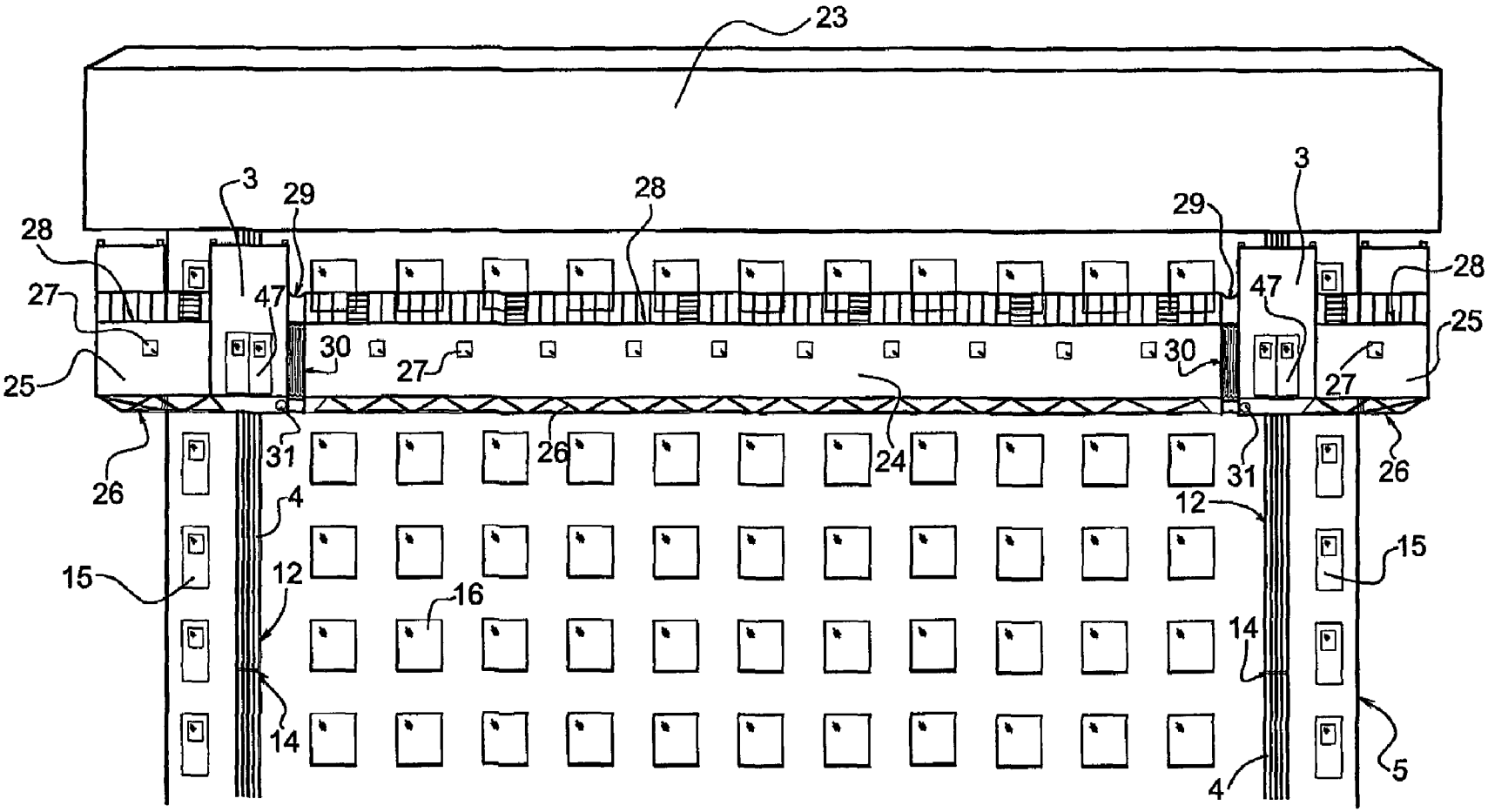
FIG. 2 shows a front view of the side of a building equipped with rails on the outside of the building and having two elevators supporting a corridor.
Figure 3:
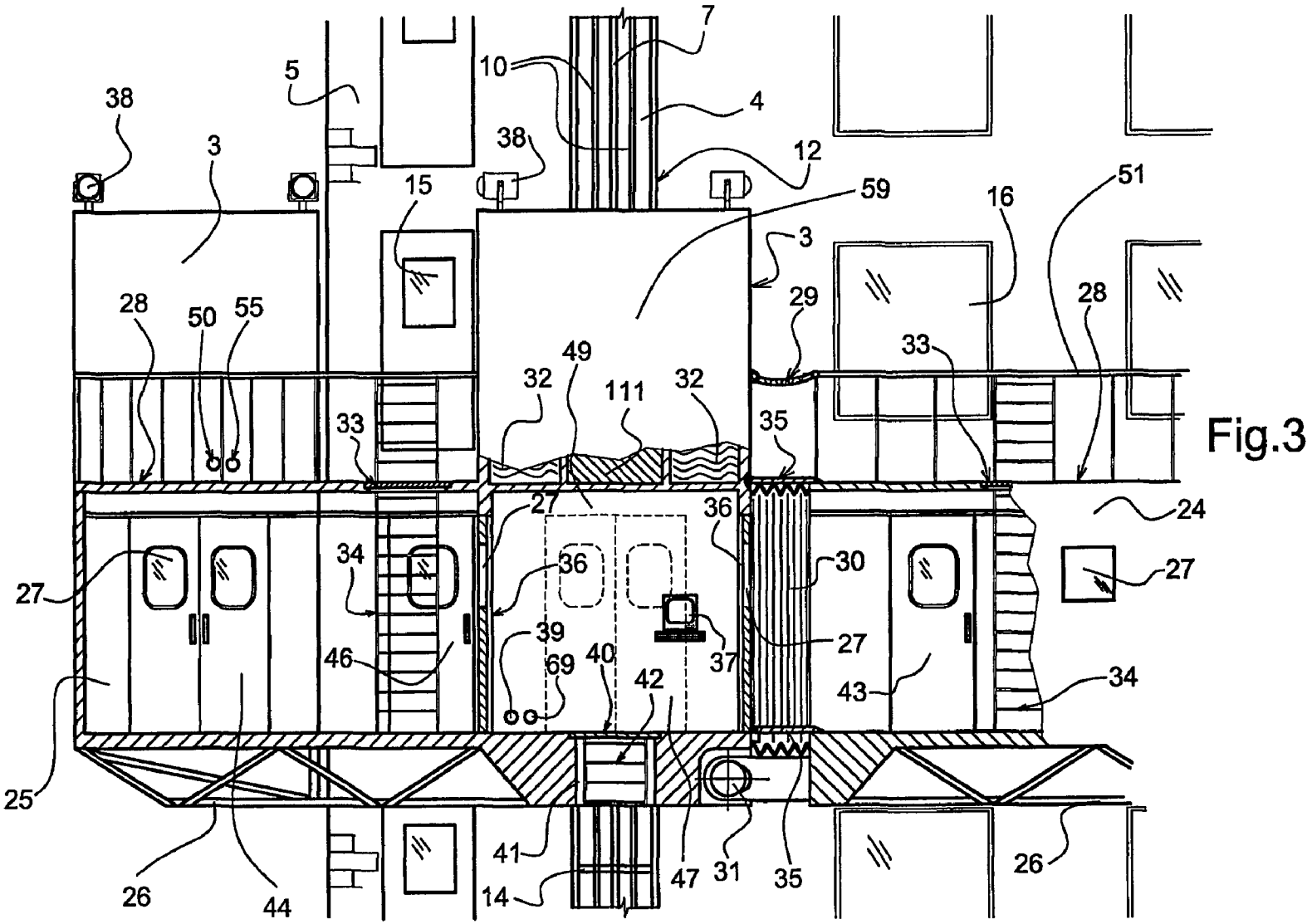
FIG. 3 a front cross sectional view of a portion of a corridor supported by an elevator on the face of a building.
Figure 4:
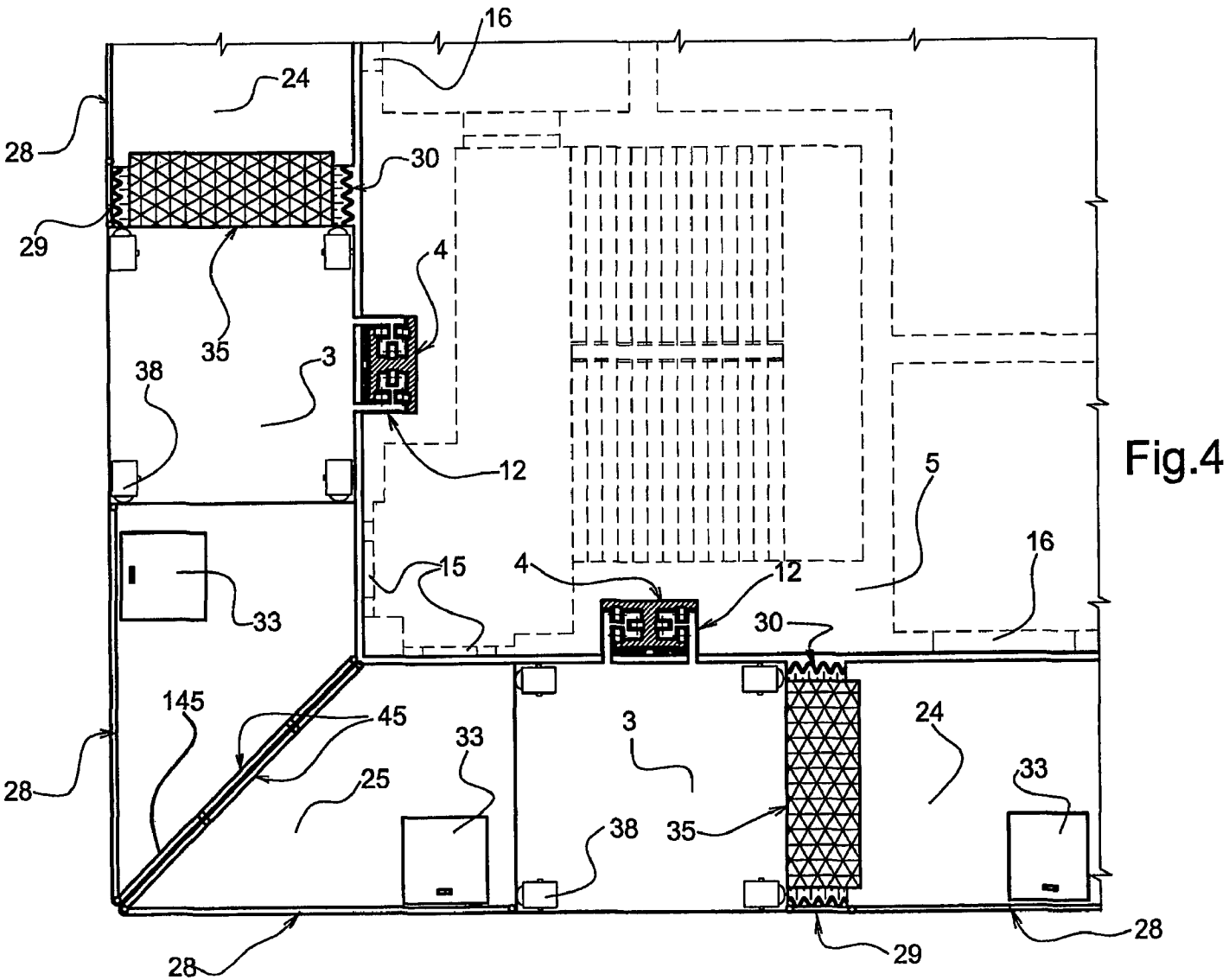
FIG. 4 shows a top view of elevators supporting corridors at the corner of a building showing how the corridors interact.
Figure 5:
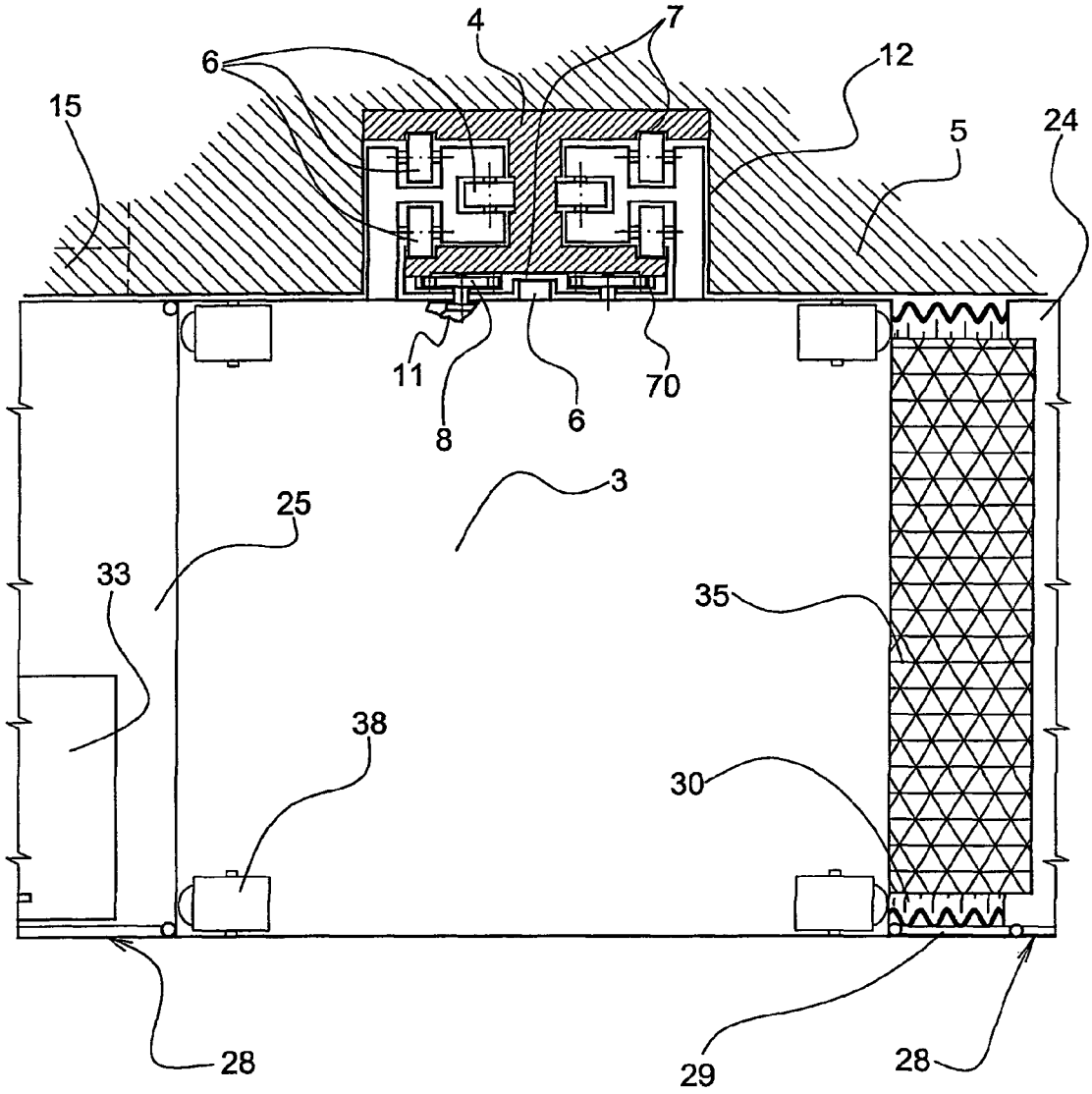
FIG. 5 shows a top view of the elevator connected to a rail on the outside surface of a building and a portion of the corridor on the elevator.
Figure 6:
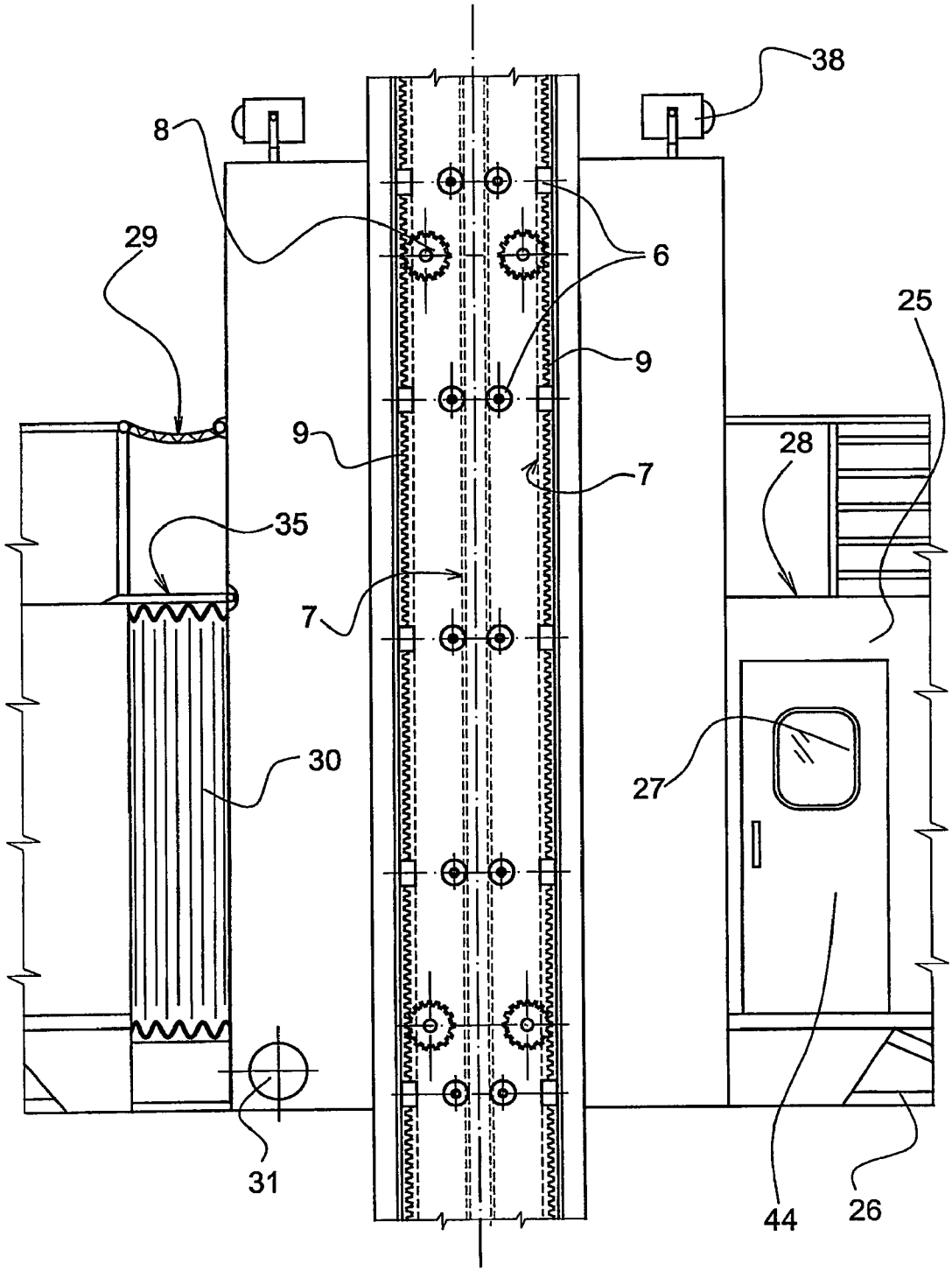
FIG. 6 shows a side view of the elevator connected to a rail on the outside surface of a building and a portion of the corridor on the elevator.
Figure 7:
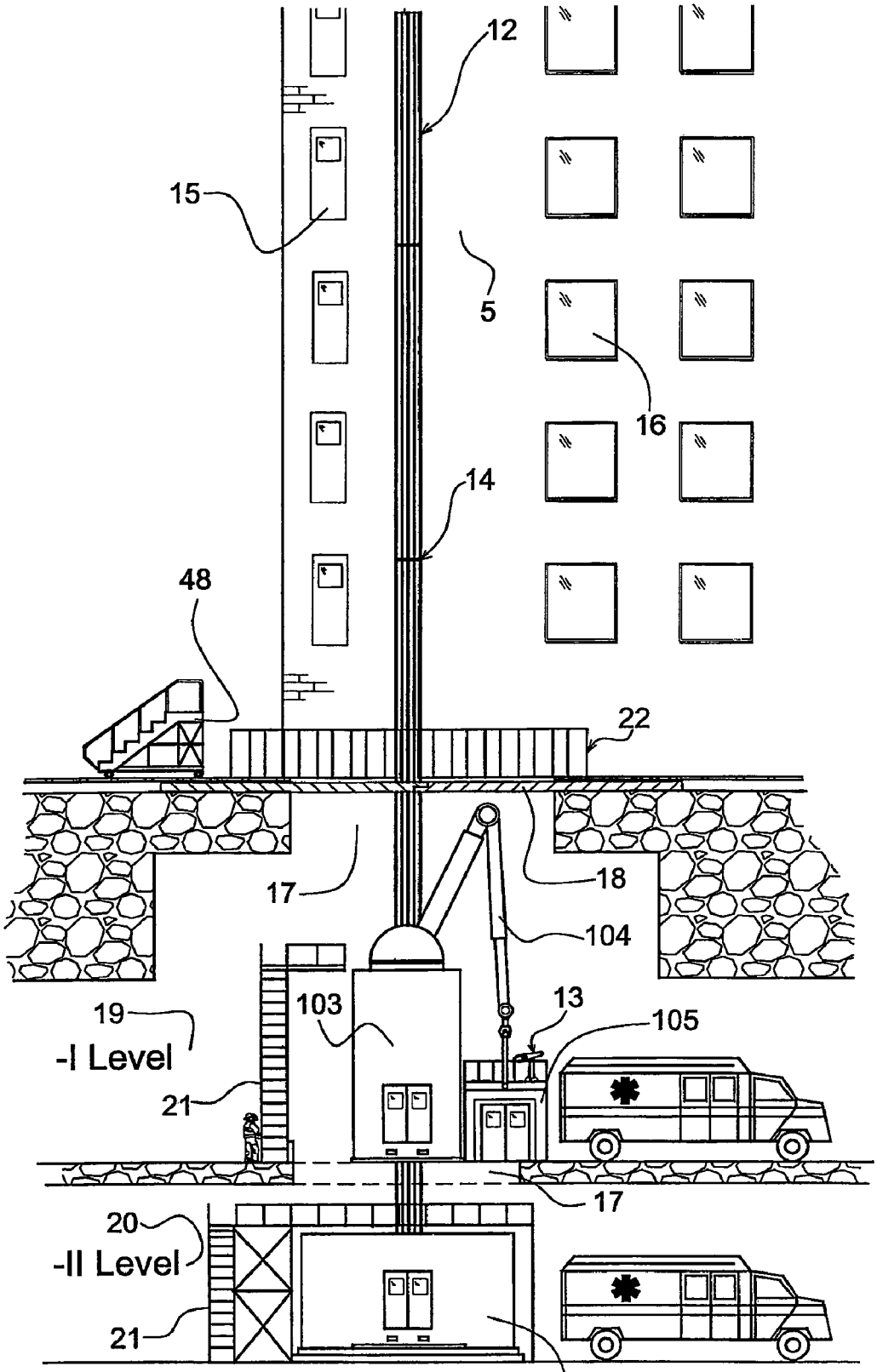
FIG. 7 shows a side view of the base of a building having an elevator with a crane and an elevator on a rail attached to the side of a building.

As FIG. 1 shows there is a building 5, which is on fire. In order to provide the building with fire fighting and rescue services the building is provided with rails 4 on the face of building 5. The rails 4 support elevators 3 which are operated in unison to support a corridor 24 therebetween. The corridor 24 has a large floor space for carrying a large number of people therein. The corridor 24 can be lifted or lowered to the floor needed to rescue people. People can then access the corridor 24 by using emergency doors 15 on the building, which are opposite doors 46 in the corridor 24 to admit people. People can also access the corridor 24 though doors 43 opposite windows 16 on building 5. Alternatively people can access the top of the scaffold 28 on top of corridor 24 at any point along the face of the building. A railing 51 is provided around the scaffold 28 for safety. A ladder 34 and trap door 33 allow people to transfer from the scaffold 28 to the corridor 24.

The corridor 24 can be lowered to the ground and people can then leave the corridor 24 through doors 47. Alternatively the corridor 24 can remain in position at one floor and elevator 203 can be used to dock with the corridor and people can transfer from the corridor 24 to the elevator 203 by accessing trap door 40 on the floor of the corridor 24 and through opening 41 and stairway 42 in truss 26 and through trap door 240 on the top of elevator 203.

The corridor 24 extends between the two elevators 3 on either side of the building 5 in the embodiment shown, however there can be three or more elevators if the face of the building is longer with corridors between all the elevators.

The elevators 3 also have a corner corridor portion 25 extending to the corner of the building such that two such corner corridor portions 25 on adjacent corners of the building 5 will meet at a 45-degree angle to form adjacent walls 145 with sliding doors 44 so that people can escape around the corner of a building. Assuming there is a fire blocking passage of a corridor 24 the corridor 24 can be parked at a floor to rescue people who can then move to an adjacent corridor 24 around the corner through corner corridor portions 25. People can also use the scaffold 28 on top of the corridor 24 and on top of the corner corridor portion 25 to be transported to safety or can transfer to the adjacent scaffold 28 by passing through gates 45. The people can then ride down to safety in the second corridor 24 or on the second scaffold 28 or reenter the building on a side away from the fire and use internal building stairs to escape the building.

The corridors 24 and corner corridor portions 25 can have inside and outside fireproof walls, and a fireproof ceiling and floor to protect the people inside. Refractory glass windows 27 in the corridors 24 help protect the passengers while letting them see out of the corridor 24 and let light into the corridor 24. The corridors 24 are supported by trusses 26 for a lightweight strong structure. The trusses 26 have rotating connection units 31 for pivotally attaching the truss to the elevator 3. The connections of the corridor 24 to the elevator 3 have moving metallic bridges 35 and corrugated elastic sheaths 30 to bridge the gap between the corridor 24 and the elevator 3. An elastic fence section 29 connects railing 51 to the upper portion 59 of elevator 3. Doors 36 with windows 27 in elevator 3 can be opened to allow people access to the corridor 24 or the corner corridor portions 25 from the elevator.

The lower portion 49 of elevator 3 is the passenger cabin the upper portion 59 holds fire suppressing foam 32 and batteries 111 for powering lights 38 for illumination, operation of doors, supplying power to the controls 37, and supplying power at jacks 39. Hose connections 69 are for connecting a hose for spraying fire suppressant foam from containers 32 on the fire.

The building 5 has rails 4 attached to the outside face. The rails 4 are preferably recessed into a groove 12 in the building surface for protection against the elements and are H shaped. The rails 4 have guide slots 7 for receiving thrust wheels 6 on the elevator, which stabilize the elevator on the rails 4. The rails 4 have teeth 70 for engaging cogwheels 8, turned by drive units 11, which are preferably electric motors. The drive units 11 raise lower or stop the elevators 3, 103 and 203.

The rails 4 have heat resistant sections 14 at intervals to absorb changes in the length of the rails due to thermal expansion or contraction.

The corridors 24 with the scaffolding 28 on top can be used to carry firemen and their equipment to the floors needed to fight the fire. The fire can also be fought from the scaffold 28 or the corridor 24.

The elevators 3 with the corridors 25 therebetween can be stored at the top of the building 5 in hangers 23 to hide them from view, or they can be stored on the ground, underground, or anyplace along the face of the building.

The fire can be fought by use of elevator 103 having a crane 104 thereon. The crane supports and moves a pod 105 which can be used for rescuing people and transporting them to either a safe place on the building, the corridor 24 or scaffold 28, elevator 203 or the ground. The pod 105 can also be used to fight the fire by use of nozzle 13 used for spraying water or fire represent chemicals or foam on the fire. The pod 105 can also be used during construction or building maintenance to access points on the face of the building or the roof. The pod 105 in the embodiments shown is supported by the crane 104 from above such that the pod can be set on the roof of the building 5 on the ground on the scaffolding 28 or on top of elevator 203.

Elevator 203 can be used to transport people from any floor of the building 5 to the ground or to bring fire fighters, workers or equipment to floors where needed.

Elevators 103 and 203 have the same wheels 6 and cogwheels 8 and drive units 11 as elevators 3 to raise and lower themselves on rails 4.

Elevator 103 can be stored underground at a first level 19 below the ground such as in the building garage. A ladder 21 or other structure can be used to service the elevator 103 or the crane 104 when stored at first level 19.

Elevator 203 can be stored underground at second level 20 and have a ladder 21 or other structure used for servicing elevator 203.

When any of the elevators 3, 103, 203 are stored underground level the elevators may have a fence 22 around the opening or vertical slot 17 in the ground adjacent the building for safety. Alternatively a sliding roof 18 may be used to store the elevators underground and out of the elements.

If the corridor 24 is positioned at ground level a stair 48 or other structure may be used for maintenance or to provide access the scaffold 28 or door 47.

The elevators 3, 103 and 203 may be attached to the building on the same rails 4 in any order, or they may be on separate rails to allow for the elevators 103, 203 to pass one another.

In case of a fire or other emergency the corridor 24 can be lowered from the top and the elevators 103 and 203 can be raised to rescue people or deliver firefighters rescue workers and equipment to anyplace on the outside face of the building. With proper positioning and coordinated use of the corridors 24 with scaffolds 28, the elevator 203 and the elevator 103 with a crane 104 and pod 105. Fires can be put out and people rescued in an efficient manner while outside of the zone of the danger inside of the building. The same corridors 24, scaffold 28, elevator 203 and elevator 103 with crane 104 and pod 105 can be used for building construction and maintenance such as window washing.

The corridor 24 may be used alone or in conjunction with elevators 103 and 203.

Obviously, many modifications and variations of the present invention are possible in light of the above teachings. It is therefore to be understood that, within the scope of the appended claims, the invention may be practiced otherwise than as specifically described.

What is claimed is:

1. A vertically mobile enclosed corridor for the face of a building comprising:

a plurality of rails attached to at least one face of a building, a first elevator car on a first rail and a second elevator car on a second rail on one face of the building, a corridor extending between the first and second elevator cars for riding up and down the face of the building when the elevator cars travel up and down the rails on the face of the building in unison, a corner corridor portion attached to the second elevator car on one face of the building extending from the second elevator car to the corner of the building, a second face of the building having a plurality of rails, with a third elevator on a third rail and a fourth elevator on a fourth rail with a corridor therebetween, and a corner corridor portion attached to the third elevator for extending to the corner of the building to engage the corner corridor portion of the second elevator car such that passengers on one corridor can transfer to the other corridor.

2. A vertically mobile enclosed corridor for the face of a building as in claim 1 having, each elevator car has a cog wheel driven by an electric motor for engaging a toothed portion of the rail for raising and lowering the elevator car.

3. A vertically mobile enclosed corridor for the face of a building as in claim 1 having, the enclosed corridor is pivotally connected to each elevator car.

4. A vertically mobile enclosed corridor for the face of a building as in claim 1 having, a scaffold on top of the corridor.

5. A vertically mobile enclosed corridor for the face of a building as in claim 1 having, a fireproof insulated wall on the enclosed corridor facing the building to protect the inside of the corridors.

6. A vertically mobile enclosed corridor for the face of a building as in claim 5 having, a fireproof insulated floor and roof on the enclosed corridor to protect the inside of the enclosed corridors.

7. A vertically mobile enclosed corridor for the face of a building as in claim 1 having, a truss for supporting the platform.

8. A vertically mobile enclosed corridor for the face of a building as in claim 1 having, doors on the enclosed corridor provide access from the enclosed corridor to the building.

9. A method for accessing the face of a building as in claim 1 having, attaching a rescue elevator car to at least one of the rails, to run up and down on the rail for accessing the face of the building and the one corridor.

10. A method for accessing the face of a building as in claim 1 having, a second rescue elevator car having a crane, the second rescue elevator attached to at least one of the rails, to run up and down on the rail.

11. A method for accessing the face of a building as in claim 10 further comprising, attaching a pod to the crane.

12. A vertically mobile enclosed corridor for the face of a building comprising, a plurality of rails attached to at least one face of a building, a first elevator car on a first rail and a second elevator car on a second rail on one face of the building, a corridor extending between the first and second elevator cars for riding up and down the face of the building when the elevator cars travel up and down the rails on the face of the building in unison, a rescue elevator attached to the first rail, a door in the top of the rescue elevator and a corresponding door in the bottom of the adjacent first elevator for transferring people from the corridor to the rescue elevator.

13. A method for accessing the face of a building as in claim 12 further comprising, incorporating a scaffold on the enclosed corridor to easily access the face of the building.

14. A method for accessing the face of a building as in claim 12 further comprising, attaching a rescue elevator car having a crane to at least one of the rails, to run up and down on the rail for accessing the face of the building.

15. A method for accessing the face of a building as in claim 14 further comprising, attaching a pod to the crane for accessing at least one of, the building, at least one elevator car, at least one enclosed corridor, and the rescue elevator.

16. A method for accessing the face of a building as in claim 12 further comprising, doors on the enclosed corridor provide access from the enclosed corridor to the building.

17. A method for accessing the face of a building as in claim 12 further comprising, a fireproof wall on the enclosed corridor facing the building to protect the inside of the corridors, and a fireproof floor and a fireproof ceiling.

18. A method for accessing the face of a building as in claim 12 further comprising, the enclosed corridor is pivotally connected to each elevator car.

* * * * *